US006137393A

United States Patent [19]

Doss Desouza et al.

[11] Patent Number: 6,137,393

[45] Date of Patent: Oct. 24, 2000

[54] POWER CORD PROVIDED WITH A POWER CORD TRANSFORMER

[75] Inventors: Argus F. C. Doss Desouza, Sunningdale, United Kingdom; Pieter J. M. Smidt; Pieter J. Van Der Zaag, both of Eindhoven, Netherlands; Martinus A. M. Gijs, Geel, Belgium; Gerjan F. A. Van De Walle, Eindhoven, Netherlands

[73] Assignee: U.S. Philips Corporation, New York, N.Y.

[21] Appl. No.: 09/358,061

[22] Filed: Jul. 21, 1999

[30] Foreign Application Priority Data

Jul. 22, 1998 [EP] European Pat. Off. ..... 98401871

[51] Int. Cl.[7] ..... H01F 17/04

[52] U.S. Cl. ..... 336/192; 336/221; 336/220; 336/233

[58] Field of Search ..... 336/221, 233, 336/220, 222; 174/68.1

[56] References Cited

U.S. PATENT DOCUMENTS

| | | | |
|---|---|---|---|
| 4,669,610 | 6/1987 | Lindsey et al. | 206/320 |
| 4,910,863 | 3/1990 | Valencic et al. | 29/606 |
| 5,036,275 | 7/1991 | Munch et al. | 324/207.17 |
| 5,349,321 | 9/1994 | Selker | 336/221 |
| 5,539,369 | 7/1996 | Selker et al. | 336/212 |

*Primary Examiner*—Michael L. Gellner
*Assistant Examiner*—Anh Mai
*Attorney, Agent, or Firm*—F. Brice Faller

[57] ABSTRACT

A power cord transformer includes a core of ferromagnetic material, a primary coil and a secondary coil both provided around the core. The core and coils have such a shape that the distance between two points on the primary coil and also the distance between two points on the secondary coil is always smaller than twice the largest axis of the power cord cross-section.

10 Claims, 1 Drawing Sheet

POWER CORD PROVIDED WITH A POWER CORD TRANSFORMER

BACKGROUND OF THE INVENTION

The invention relates to a power cord having a first and a second end, provided with a power cord transformer comprising a core of ferromagnetic material, and a first wire wound around a part of the core as primary coil and a second wire wound around a part of the core as secondary coil, the ends of the first wire extending to the first end of the power cord and the ends of the second wire extending to the second end of the power cord. This type of power cord is particularly used for portable apparatuses used on journeys. Examples are portable telephones, portable computers and shavers.

U.S. Pat. No. 5,539,369 describes a power cord of this type with a power cord transformer having a core which consists of a plurality of separate toroids whose axes are in alignment. The toroids thus form a row. The primary coil of this transformer consists of a wire which is wound around the row of toroids. To this end, the conducting wire constituting this coil is wound a number of times in the axial direction within and outside the row of toroids. The secondary coil consists of a similarly wound wire.

The known power cord has drawbacks in practice. It has been found that an unacceptably high percentage of these cords becomes defective during use by consumers. The method of producing the power cord described in the patent is also very cumbersome. In this method, separate wire pieces are provided and subsequently secured to each other.

SUMMARY OF THE INVENTION

It is an object of the invention to provide a durable power cord which can be manufactured easily.

According to the invention, the shape of the core and the coils is chosen to be such that the distance between any combination of two points on a single turn of the primary and secondary coil is smaller than twice the length of largest axis of the power cord cross-section. For a core with a round cross-section, this distance is the diameter of the coils.

The invention is also based on the recognition, gained by experiment, that the wires wound around the elongated coils of the known transformer may easily be damaged when the cord is bent strongly. Notably apparatuses taken along on journeys are often packed and unpacked, at which the power cord is usually deformed considerably. Under these circumstances, there is a great risk of wire breakage.

By using the measure according to the invention, it is achieved that the wound wires no longer extend through a large length of the cord. The risk of wire breakage in the cord is thereby reduced considerably.

The core preferably extends through at least 50% of the length of the power cord and has a first and a second end, the primary coil being located at the first end of the core and the secondary coil being located at the second end of the core. A substantial part of the core between the primary and secondary coils is free from coils. By using this measure, not only the primary and secondary coil have limited dimensions but the input and output wires have a short length as well. Consequently, there is an even smaller risk of cord breakage and the cord has a greater reliability.

The core is made of flexible material. In this way, a large part of the cord length can be bridged with the core, so that the input and output wires can be shorter. Moreover, another cause of rejection is avoided thereby. It has been found that the toroids of the power cord described in U.S. Pat. No. 5,539,369 may break to pieces if pressure is exerted. This may already happen easily if a person accidentally stands on the power cord, which is a situation that may occur several times under normal use. By using a flexible core, this core breakage no longer occurs either.

The flexible material may be a thermoplastic binder or a reactive binder. Inter alia, polyurethanes are a good choice. These materials are very flexible, durable and easily available. They are available as molding mass and as thermoplasts. Another possibility is silicons. These materials are very rigid and have a long lifetime. Other interesting materials are polyamides. Various polyamides are available which have a lower viscosity than the above-mentioned materials during processing. This simplifies the production of the cores.

Preferably the flexible material consists of a composite comprising a magnetic flux-conducting material and a polymer. The polymer provides the desired flexibility. The magnetic flux-conducting material is preferably a soft-magnetic material. A suitable magnetic material is ferrite. This has such a high resistance that it functions satisfactorily in a transformer having an internal frequency of between 49 and 149 kHz. This is a favorable range for transformers used in portable apparatuses. A lower frequency would result in too large dimensions of the transformer. A higher frequency would result in too much interference of surrounding apparatuses and lead to too much dissipation of energy. In accordance with a preferred embodiment, the magnetic flux-conducting material comprises ferrite. An additional advantage of the use of the composite of magnetically conducting material and polymer is the fact that this material can be manufactured by means of molding. These molding processes may be molding, pressing, injection molding or reactive injection molding. A core of this material can thus be made more easily than a core of a conventional material which must be sintered and/or ground.

In practice, this embodiment may be implemented as a power cord in which the core has an oval shape, the primary coil and the secondary coil being wound around ends of the oval. This has the advantage that the magnetic field lines close automatically through the ring, which simplifies the transformation. The energy losses upon transformation are thus reduced considerably.

The described embodiment using the flexible core may also be implemented as a power cord in which the core is rod-shaped, the primary coil being situated on a first end of the rod and the secondary coil being situated on the second end of the rod, a tubular envelope of flexible magnetically conducting material around the core constituting a return path for the field lines. The field lines are closed through the tubular envelope so that a coax construction is provided. This has the great advantage that a rod-shaped core is more rigid than a folded ring. The risk of cracks or breakage due to strong bending is very small in this embodiment. It is only the bending of the cord during use which affects the core but can easily be withstood by this core.

Another advantageous embodiment of the power cord it is helical. The core is then also helical. The primary coil is wound around the first end of the core and the secondary coil is wound around the second end of the core. An advantage of this embodiment is that the core in a helical cord needs to be substantially less flexible than a straight cord. Consequently, the core can be manufactured at lower cost.

An embodiment of the power cord includes a plug which is secured to the cord via a strain-relief grommet, and the transformer is accommodated in the strain-relief grommet. The strain-relief grommet occupies a given minimum space which is not significantly increased by the incorporation of the transformer. The space within the power cord is utilized more efficiently by accommodating the transformer in the strain-relief grommet.

The power cord may be extended to any desired length by means of an extension cord.

These and other aspects of the invention are apparent from and will be elucidated with reference to the embodiments described hereinafter.

DETAILED DESCRIPTION OF THE PREFERRED EMBODIMENTS

Figure 1:
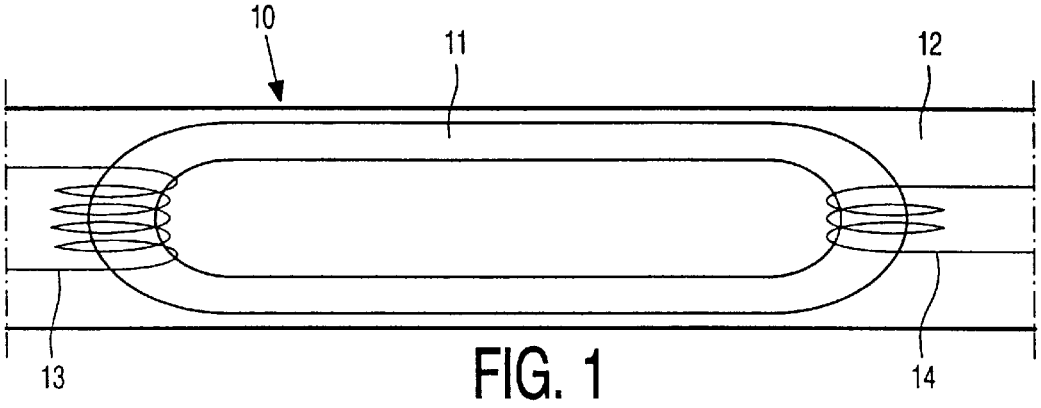
FIG. 1 shows diagrammatically a part of an embodiment of a power cord according to the invention, in which the core of the transformer has an oval shape.

FIG. 1 is a diagrammatic cross-section of a part of an embodiment of a power cord 10 according to the invention, in which the core 11 of the transformer 12 has an oval shape. The primary coil 13 and the secondary coil 14 of the transformer 12 are wound around the ends of the oval core 11. The core 11 is made of a flexible material so that the cord 10 can bend without any hindrance and without damage of the core 11.

Figure 2:
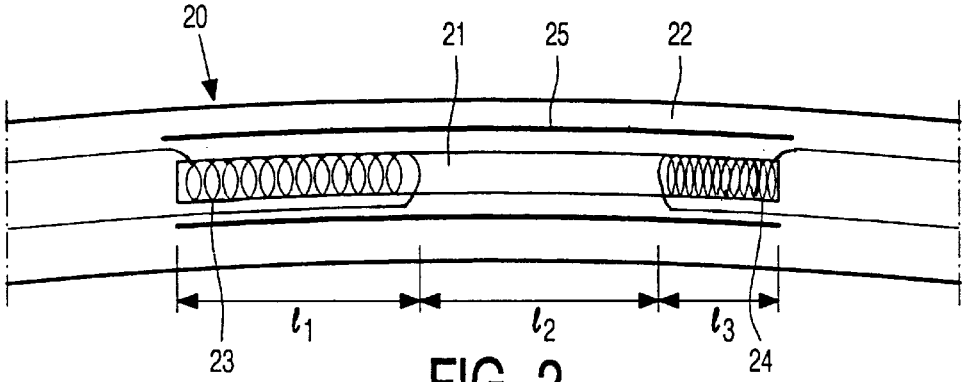
FIG. 2 shows diagrammatically a part of a power cord according to the invention, in which the core of the transformer is rod-shaped.

FIG. 2 is a diagrammatic cross-section of a part of a power cord 20 according to the invention, in which the core 21 of the transformer 22 is rod-shaped. The primary coil 23 and the secondary coil 24 of the transformer 22 are wound around the ends of the rod-shaped core 21. To close the magnetic field lines in the transformer 22, an envelope 25 is provided around the core 21 so that a coax construction is obtained.

An example of a satisfactorily functioning power cord has the following dimensions. The primary coil has a length $l_1$ of 3 cm and 330 turns. The secondary coil has a length $l_3$ of 1 cm and 114 turns. A sustantial part of the core which is not wound and has a length $l_2$ of 1 cm (20% of the total length of the core) is present between the two coils. The core is then approximately 5 cm long. The core has a diameter of 5 mm. The primary and the secondary coil have a diameter of between 5 and 8.5 mm. The Figure shows that the diameters of the primary and secondary coil are smaller than twice the largest axis of the power cord cross-section (which is the diameter in this case).

The envelope 25 has a wall thickness of 1.4 mm. The total power cord 20 has a diameter of approximately 1 cm. In this case, a polymer-ferrite composite, approximately 54 vol.% of which consists of pulverized MnZn ferrite, was used for the core 21. At this percentage of ferrite, the magnetic induction is enough to obtain a satisfactory transformation at the chosen number of turns for the primary coil 23 and secondary coil 24.

Figure 3:
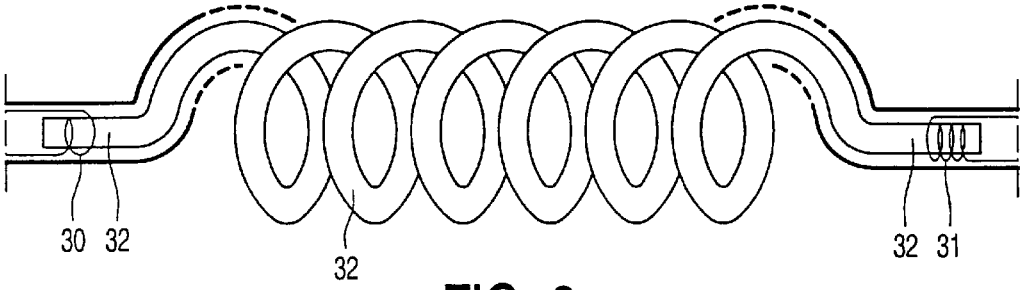
FIG. 3 shows diagrammatically a part of a power cord according to the invention, in which the transformer is present in a helical part of the cord which is helical.

FIG. 3 is a diagrammatic cross-section of a part of a power cord according to the invention, in which the transformer is present in a helical part of the cord. The primary coil 30 and the secondary coil 31 are wound around core 32 the ends of a helical. Due to the resilient properties of the shape, the core needs to be less flexible than a rod-shaped core.

Figure 4:
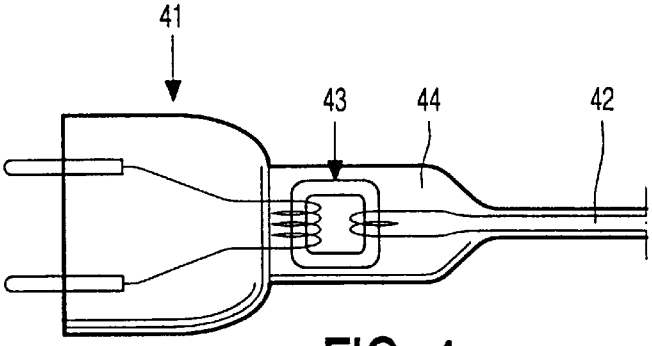
FIG. 4 shows diagrammatically the plug of an embodiment of a power cord according to the invention, in which the transformer is accommodated in the strain-relief grommet.

FIG. 4 is a diagrammatic cross-section of the plug 41 of an embodiment of a power cord 42 according to the invention, in which the transformer 43 is accommodated in the strain-relief grommet 44. The plug 41 is connected to the power cord 42. To ensure that the power cord cannot bend too sharply, a strain-relief grommet 44 is present between the head of the plug 41 and the power cord 42. The transformer 43 is accommodated in this strain-relief grommet 44. Consequently, the transformer 43 does not occupy any extra space.

What is claimed is:

1. A power cord having a first and a second end, provided with a power cord transformer comprising a core of ferromagnetic material, and a first wire wound around a part of the core as primary coil and a second wire wound around a part of the core as secondary coil, a substantial part of the core between the primary and secondary coils being free from coils, the first wire having ends extending to the first end of the power cord and the second wire having ends extending to the second end of the power cord, wherein the distances between any two points on a single turn of the primary coil and between any two points on the secondary coil are smaller than twice the length of the largest axis of the power cord cross-section.

2. A power cord as claimed in claim 1 further comprising a plug which is secured to the cord via a strain-relief grommet, wherein the transformer is accommodated in said strain-relief grommet.

3. A power cord as claimed in claim 1, wherein the core extends through at least 50% of the length of the power cord, and the core has a first and a second end, the primary coil being situated at the first end of the core and the secondary coil being situated at the second end of the core.

4. A power cord as claimed in claim 3 wherein the power cord is helical.

5. A power cord as claimed in claim 1 wherein the core is made of flexible material.

6. A power cord as claimed in claim 5, characterized in that the intrinsic flexible material consists of a composite comprising a magnetic flux-conducting material and a polymer.

7. A power cord as claimed in claim 6, characterized in that the magnetic flux-conducting material comprises ferrite.

8. A power cord as claimed in claim 5 wherein the core has an oval shape with ends, the primary coil and the secondary coil being wound around the ends of the oval-shaped core.

9. A power cord as claimed in claim 5 wherein the core is rod-shaped, the primary coil being situated on a first end of the rod and the secondary coil being situated on the second end of the rod, the coil further comprising a tubular envelope of an intrinsic flexible magnetically conducting material around the core, which envelope provides a return path for the field lines.

10. A power cord as in claim 9 wherein said substantial part is 20% of the total length of the core.

* * * * *